US009827568B2

(12) United States Patent
Aberg et al.

(10) Patent No.: US 9,827,568 B2
(45) Date of Patent: Nov. 28, 2017

(54) GYRATORY CRUSHER MAIN SHAFT SLEEVE

(71) Applicant: SANDVIK INTELLECTUAL PROPERTY AB, Sandviken (SE)

(72) Inventors: Niklas Aberg, Sodra Sandby (SE); Bengt-Arne Eriksson, Svedala (SE); Fredrik Rosdahl, Sandviken (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 349 days.

(21) Appl. No.: 14/418,535

(22) PCT Filed: Jun. 20, 2013

(86) PCT No.: PCT/EP2013/062861
§ 371 (c)(1),
(2) Date: Jan. 30, 2015

(87) PCT Pub. No.: WO2014/019765
PCT Pub. Date: Feb. 6, 2014

(65) Prior Publication Data

US 2015/0202630 A1 Jul. 23, 2015

(30) Foreign Application Priority Data

Aug. 2, 2012 (EP) ..... 12179089

(51) Int. Cl.
*B02C 2/00* (2006.01)
*B02C 2/06* (2006.01)

(52) U.S. Cl.
CPC ..... *B02C 2/005* (2013.01); *B02C 2/00* (2013.01); *B02C 2/06* (2013.01)

(58) Field of Classification Search
CPC ..... B02C 2/005; B02C 2/06; B02C 2/00
USPC ..... 241/215, 209
See application file for complete search history.

(56) References Cited

U.S. PATENT DOCUMENTS 1,402,255 A 1/1922 Sanborn
3,539,119 A * 11/1970 Cook ..... B02C 2/047 241/215
3,813,047 A * 5/1974 Torrence ..... B02C 2/06 241/211
4,027,825 A 6/1977 Coxhill
4,037,800 A * 7/1977 Coxhill ..... B02C 2/06 241/213

(Continued)

FOREIGN PATENT DOCUMENTS

CN 2212448 Y 11/1995
CN 101947476 A 1/2011

(Continued)

*Primary Examiner* — Faye Francis
(74) *Attorney, Agent, or Firm* — Corinne R. Gorski

(57) ABSTRACT

A gyratory crusher main shaft sleeve friction fit over an uppermost end of a crusher main shaft. The sleeve includes an elongate axial wall for being positioned in contact with an outward facing surface of the main shaft. The axial wall has a thickness that decreases in a direction from a second upper end to a first lower end, wherein the internal facing surface of the sleeve extends transverse to a longitudinal axis of the sleeve so as to taper inwardly towards the axis in a direction from the first to the second end.

10 Claims, 2 Drawing Sheets

(56) References Cited

U.S. PATENT DOCUMENTS

| | | | | | |
|---|---|---|---|---|---|
| 4,060,205 | A * | 11/1977 | Pollak | B02C 2/047 | 138/26 |
| 4,065,064 | A | 12/1977 | James | | |
| 5,152,468 | A * | 10/1992 | Virtamo | B02C 2/06 | 241/213 |
| 5,820,045 | A * | 10/1998 | Karra | B02C 2/00 | 241/207 |
| 5,934,583 | A | 8/1999 | Jean | | |
| 6,446,892 | B1 * | 9/2002 | Fasoli | B02C 2/04 | 241/207 |
| 8,646,713 | B2 * | 2/2014 | Belotserkovskiy | B02C 2/042 | 241/207 |
| 2002/0088885 | A1 | 7/2002 | Van Mullem et al. | | |
| 2011/0006143 | A1 * | 1/2011 | Gunnarsson | B02C 2/04 | 241/215 |

FOREIGN PATENT DOCUMENTS

| | | | |
|---|---|---|---|
| CN | 203678427 | U | 7/2014 |
| DE | 371447 | C | 3/1923 |
| DE | 681942 | C | 10/1939 |
| DE | 10346475 | B3 | 3/2005 |
| GB | 1031679 | | 6/1966 |
| SE | 421864 | B | 2/1982 |

* cited by examiner

GYRATORY CRUSHER MAIN SHAFT SLEEVE

RELATED APPLICATION DATA

This application is a §371 National Stage Application of PCT International Application No. PCT/EP2013/062861 filed Jun. 20, 2013 claiming priority of EP Application No. 12179089.3, filed Aug. 2, 2012.

FIELD OF INVENTION

The present invention relates to a gyratory crusher main shaft sleeve for positioning at an uppermost end of a crusher main shaft and in particular, although not exclusively, to a sleeve having a tapered wall thickness.

BACKGROUND ART

Gyratory crushers are used for crushing ore, mineral and rock material to smaller sizes. Typically, the crusher comprises a crushing head mounted upon an elongate main shaft. A first crushing shell is mounted on the crushing head and a second crushing shell is mounted on a frame such that the first and second crushing shells define together a crushing gap through which the material to be crushed is passed. A driving device is arranged to rotate an eccentric assembly about the lower portion of the shaft so as to cause the crushing head to perform a gyratory pendulum movement and crush the material introduced in the crushing gap. US 2009/0008489 discloses a hydraulically adjustable cone crusher in which an axial bearing assembly comprises a hydraulic adjustment cylinder for adjusting the setting of the crusher. U.S. Pat. No. 4,919,349 discloses a gyratory crusher having a dual seal arrangement that utilises forced air and a gasket arrangement to block contaminants entering the crusher. SU 897280 describes a cone crusher that has a step cup bearing to absorb and transmit the crushing force of the crusher head.

The gyratory pendulum movement of the crushing head is supported by a lower bearing assembly positioned below the crushing head and a top bearing into which an upper end of the main shaft is journalled. Typically, the main shaft upper end is protected against wear by a sleeve. Commonly, the protective sleeve comprises a cylindrical geometry and is held at the main shaft via an interference or friction fit. This arrangement however requires the sleeve to be heated to increase its diameter to enable mounting and possible disassembly at the main shaft.

Example protective sleeves are disclosed in U.S. Pat. No. 1,592,313; U.S. Pat. No. 1,748,102; RU 718160 and RU 940837.

However, a number of problems exist with conventional protective sleeves. In particular, if the time taken to friction fit the heated sleeve onto the main shaft end is too great it is not uncommon for the sleeve to cool and shrink before it is forced onto the shaft to the correct and final position. Additionally, disassembly is often problematic as the sleeve is required to be cut before it can be removed. On large crushers, protective sleeves have a substantial wall thickness and this cutting operation can be time and labour intensive with the added risk of potential damage to the shaft. What is required is a main shaft sleeve that addresses the above problem.

SUMMARY OF THE INVENTION

It is an object of the present invention to provide a sleeve for a main shaft of a gyratory crusher that enables convenient attachment and detachment at the shaft so as to be quickly and conveniently assembled and disassembled.

The objective is achieved by providing a sleeve having an internal facing surface that tapers inwardly in the axial direction towards a longitudinal axis of the sleeve from a first (lower) end to a second (upper) end. The present sleeve arrangement is configured for secure mounting in position via an interference or friction fit arrangement in direct contact with a tapered end region of the main shaft. In particular, a conical shape profile of the internal facing surface of the sleeve is capable of sliding over a corresponding conical shaped main shaft end region without risk of the sleeve seizing prematurely at the shaft before reaching its fully matted position. As with existing devices, the present sleeve may be heated to increase its diameter immediately prior to assembly. Similarly, to facilitate disassembly, heat may be applied to the sleeve together with mechanical agitation.

According to a first aspect of the present invention there is provided a gyratory crusher main shaft sleeve for friction fitting over an uppermost end of a crusher main shaft, the sleeve comprising: an elongate axial wall extending around a longitudinal axis of the sleeve, the wall having an internal facing surface for positioning in contact with an outward facing surface of the main shaft, and an external facing surface relative to the longitudinal axis, the wall extending between the internal and external facing surfaces; the wall having a first end for positioning at a lower region of the main shaft and a second end for positioning at an upper region of the main shaft relative to the lower region; wherein a thickness of the wall at a region between the first and second ends decreases in a direction from the second end to the first end; characterised in that: in the axial direction the internal facing surface at said region extends transverse to the longitudinal axis so as to taper inwardly towards the axis in the direction from the first to the second end.

Preferably, the region over which the thickness of the wall decreases extends substantially the full axial length of the sleeve.

Preferably, the sleeve further comprises a radial wall extending perpendicular or transverse to the axial wall, the radial wall positioned at or towards the second end and extending inwardly towards the longitudinal axis. Optionally, the radial wall comprises a through bore positioned at the longitudinal axis of the sleeve.

Preferably, a cross sectional shape profile of the external facing surface is substantially circular. Preferably, a cross sectional shape profile of the internal facing surface is substantially circular. Preferably, a shape profile of the external facing surface defines a section of a cylinder in the axial direction. Preferably, a shape profile of the internal facing surface defines a section of a cone in the axial direction.

Optionally, the sleeve comprises at least one groove indented in the internal facing surface. Additionally, the groove may extend in a circumferential direction around a region of the internal facing surface. Optionally, the groove extends in a direction axially along the internal facing surface. Optionally, the sleeve may further comprise at least one bore provided through the wall to allow the passage of a fluid to the internal facing surface. Accordingly, the bore is capable of allowing a lubricating fluid to be introduced through the body of the sleeve so as to flood the region between the internal facing surface of the sleeve and the external facing surface of the main shaft at the region of the sleeve. Where the sleeve comprises a groove at the internal facing surface, the lubricating fluid is capable of flowing within the groove both circumferentially and axially to fully lubricate the sleeve and main shaft interface.

Optionally, at a region of the first end, the internal facing surface is curved radially outward relative to the longitudinal axis in a direction towards the external facing surface such that the wall thickness decreases to zero at the curved region.

According to a second aspect of the present invention there is provided a gyratory crusher main shaft comprising: a shaft body having a first end for positioning at a lower region of the crusher and a second end for positioning at an upper region of the crusher relative to the first end; characterised in that: a thickness of the shaft body is tapered in the axial direction of the main shaft at a region of the second end so as to decrease in cross sectional area; and the main shaft further comprises a sleeve as detailed herein friction fitted over the tapered region at the second end of the main shaft.

According to a third aspect of the present invention there is provided a gyratory crusher comprising a main shaft and a sleeve as described herein.

BRIEF DESCRIPTION OF DRAWINGS

A specific implementation of the present invention will now be described by way example only and with reference to the following drawings in which.

DETAILED DESCRIPTION OF PREFERRED EMBODIMENT OF THE INVENTION

Figure 1:
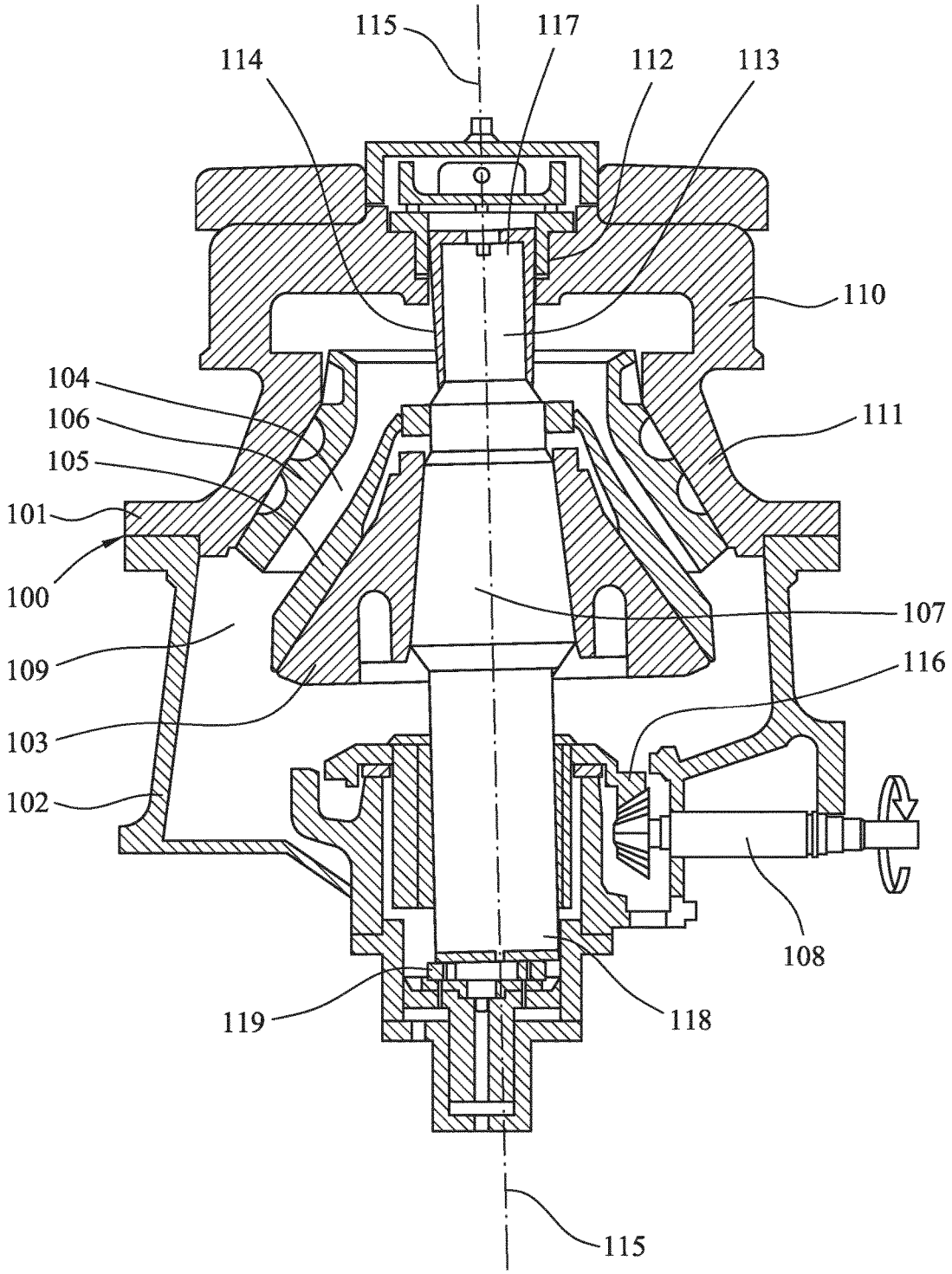
FIG. 1 is a cross-sectional side view of a gyratory crusher having a main shaft supported at its upper end by a top bearing set and having a protective sleeve mounted about the upper end of the main shaft according to a specific implementation of the present invention.

Referring to FIG. 1, a crusher comprises a frame 100 having an upper frame 101 and a lower frame 102. A crushing head 103 is mounted upon an elongate shaft 107. A first crushing shell 105 is fixably mounted on crushing head 103 and a second crushing shell 106 is fixably mounted at top frame 101. A crushing zone 104 is formed between the opposed crushing shells 105, 106. A discharge zone 109 is positioned immediately below crushing zone 104 and is defined, in part, by lower frame 102.

Upper frame 101 is further divided into a topshell 111, mounted upon lower frame 102 (alternatively termed a bottom shell), and a spider that extends from topshell 111 and represents an upper portion of the crusher. The spider comprises two diametrically opposed arms 110 that extend radially outward from a central cap positioned on a longitudinal axis 115 extending through frame 100 and the gyratory crusher generally.

Arms 110 are attached to an upper region of topshell 111 via an intermediate annular flange that is centred around longitudinal axis 115. Typically, arms 110 and topshell 111 form a unitary structure and are formed integrally.

A drive (not shown) is coupled to main shaft 107 via a drive shaft 108 and suitable gearing 116 so as to rotate shaft 107 eccentrically about longitudinal axis 115 and to cause crushing head 103 to perform a gyratory pendulum movement and crush material introduced into crushing gap 104. An upper end region of a shaft 113 comprises an axial taper to define an upper conical section. The cone 113 tapers inwardly in the bottom to top direction away from head 103. A very uppermost end 117 of shaft 107 is maintained in an axially rotatable position by a top bearing assembly 112. Similarly, a bottom end 118 of shaft 107 is supported by a bottom bearing assembly 119.

To avoid excessive wear of the upper conical portion 113, a substantially cylindrical wear sleeve 114 is mounted over and about shaft region 113. Sleeve 114 is held in position at region 113 by an interference of friction fit and is provided in close touching contact over the axial length of sleeve 114. Accordingly, sleeve 114 is positioned intermediate between bearing assembly 112 and region 113 to absorb the radial and axial loading forces resultant from the crushing action of the gyratory pendulum movement.

Figure 2:
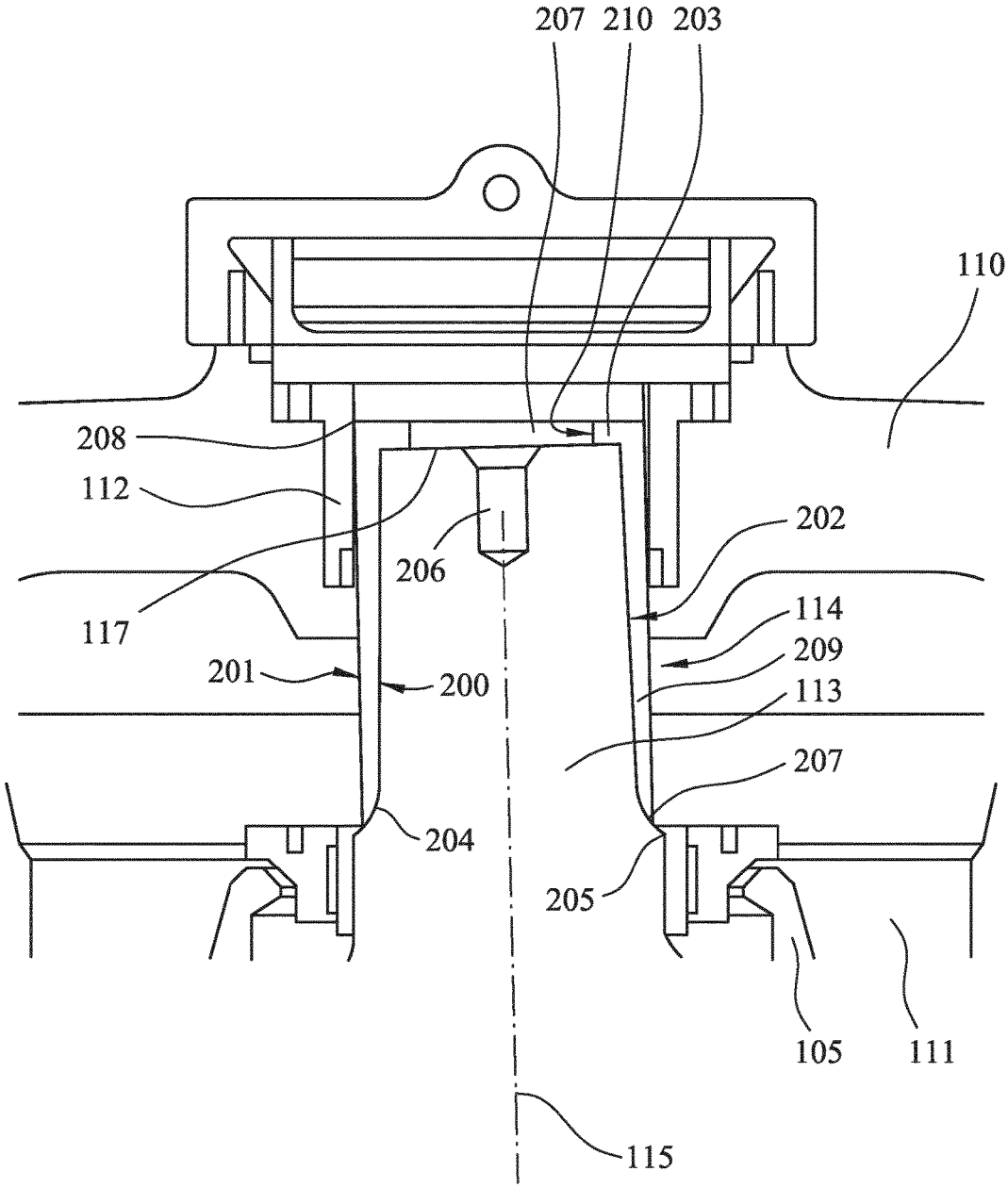
FIG. 2 is a magnified view of the upper region of the crusher of FIG. 1.

With reference to FIG. 2, sleeve 114 comprises an external facing surface 201 and an internal facing surface 200, the orientation of faces 201, 200 being relative to the longitudinal axis 115 extending through shaft region 113 and sleeve 114. Internal facing surface 200 is secured in direct contact against an external facing surface 202 of conical region 113. Accordingly, internal facing surface 200 tapers inwardly towards longitudinal axis 115 from a first end 207 and a second end 208, where the first end 207 is positioned below second end 208 within the crusher during normal use. A cross sectional shape profile of internal facing surface 200 and external facing surface 201 is circular substantially the length of sleeve 114 between first and second ends 207, 208. However, external facing surface 201 is aligned substantially parallel with axis 115 such that sleeve 114 when viewed externally comprises a substantially cylindrical geometry. According to this configuration, the annular axial wall 209 of sleeve 114 that is defined between apposed surfaces 200, 201 comprises a thickness that tapers and reduces in a direction from second upper end 208 to first lower end 207. As will be appreciated, to enable sleeve 114 to fit in close shrink-fit contact with conical end portion 113, the taper angle of inner surface 200 is substantially equal to the taper angle of the external facing surface 202 of shaft region 113 relative to axis 115.

At first end 207, a thickness of walls 209 decrease sharply as internal facing surface 200 curves outwardly 204 forwards external facing surface 201. This curved or sharp annular edge region 204 is configured to fit in close contact against a shoulder region 205 of shaft 107 that curves radially outward at a region immediately above crushing shell 105 and head 103.

Uppermost end 117 of shaft 107 is retained in position by a mounting pin 206, aligned at axis 115, that extends axially downward from a mounting boss 207. Boss 207 and pin 206 are positioned coaxially with shaft end 113 and sleeve 114.

A radial wall 203 extends perpendicular to axial wall 209 and is orientated inwardly towards axis 115 at second end 208. A bore 210 is provided through radial wall 203 of a diameter sufficient to accommodate boss 207 such that wall 203 extends around boss 207 from axial wall 209. Accordingly, sleeve 114 is fully mated in position over conical shaft region 113 when radial wall 203 is seated against shaft end 117. In this configuration, axial wall 209 is positioned intermediate between top bearing 112 and shaft region 113.

According to the specific implementation, the axial wall 209 comprises a thickness that decreases from second end 208 to first end 207 uniformly over the entire length of sleeve 114 with the exception of curved end region 204.

The invention claimed is:

1. A gyratory crusher comprising:

a main shaft including a shaft body having a first end for positioning at a lower region of the crusher and a second end for positioning at an upper region of the crusher relative to the first end, a thickness of the shaft body being tapered in an axial direction of the main shaft at a region of the second end so as to decrease in cross-sectional area; and a sleeve fitted over the tapered region at the second end of the main shaft, the sleeve including an elongate axial wall extending around a longitudinal axis of the sleeve, the axial wall having an internal facing surface for positioning in contact with an outward facing surface of the main shaft, and an external facing surface relative to the longitudinal axis, the axial wall extending between the internal and external facing surfaces, the axial wall having a first end for positioning at a lower region of the main shaft and a second end for positioning at an upper region of the main shaft relative to the lower region, wherein a thickness of the axial wall at a region between the first and second ends decreases in a direction from the second end to the first end, in the axial direction the internal facing surface at said region between the first and second ends extending transverse to the longitudinal axis so as to taper inwardly towards the longitudinal axis in the direction from the first to the second end.

2. The gyratory crusher as claimed in claim 1, wherein the region over which the thickness of the axial wall decreases extends substantially the full axial length of the sleeve.

3. The gyratory crusher as claimed in claim 1, further comprising a radial wall extending perpendicular or transverse to the axial wall, the radial wall being positioned at or towards the second end and extending inwardly towards the longitudinal axis.

4. The gyratory crusher as claimed in claim 3, wherein the radial wall includes a through bore positioned at the longitudinal axis of the sleeve.

5. The gyratory crusher as claimed in claim 1, wherein a cross-sectional shape profile of the external facing surface is substantially circular.

6. The gyratory crusher as claimed in claim 1, wherein a cross-sectional shape profile of the internal facing surface is substantially circular.

7. The gyratory crusher as claimed in claim 1, wherein a shape profile of the external facing surface defines a section of a cylinder in the axial direction.

8. The gyratory crusher as claimed in claim 1, wherein a shape profile of the internal facing surface defines a section of a cone in the axial direction.

9. The gyratory crusher as claimed in claim 1, further comprising at least one bore provided through the axial wall to allow the passage of a fluid to the internal facing surface.

10. The gyratory crusher as claimed in claim 1, wherein at a curved region of the first end, the internal facing surface is curved radially outward relative to the longitudinal axis in a direction towards the external facing surface such that the axial wall thickness decreases to zero at the curved region.

* * * * *